US009212462B2

(12) United States Patent
Borel et al.

(10) Patent No.: US 9,212,462 B2
(45) Date of Patent: Dec. 15, 2015

(54) WALL FORMED IN SOIL, THE WALL INCLUDING A HOLLOW PREFABRICATED ELEMENT, AND A METHOD OF MAKING SUCH A WALL

(75) Inventors: Serge Borel, Rueil Malmaison (FR); Jean Pierre Hamelin, Rueil Malmaison (FR); Joël Cano, Rueil Malmaison (FR); Fabrice Mathieu, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 13/115,821

(22) Filed: May 25, 2011

(65) Prior Publication Data

US 2012/0000148 A1 Jan. 5, 2012

(30) Foreign Application Priority Data

May 25, 2010 (FR) ..... 10 54019

(51) Int. Cl.
*E02D 29/05* (2006.01)
*E02D 5/18* (2006.01)
*E02D 17/13* (2006.01)

(52) U.S. Cl.
CPC . *E02D 5/18* (2013.01); *E02D 17/13* (2013.01)

(58) Field of Classification Search
CPC ..... E02D 5/022; E02D 5/05; E02D 5/20; E02D 517/08
USPC ..... 405/286, 287, 287.1; 52/741.13, 52/741.15; 264/31, 33
See application file for complete search history.

(56) References Cited

U.S. PATENT DOCUMENTS

| | | | | | |
|---|---|---|---|---|---|
| 745,453 | A | * | 12/1903 | McBean | 405/274 |
| 4,073,148 | A | * | 2/1978 | Zaretti | 405/287 |
| 4,075,852 | A | * | 2/1978 | Tamaro | 405/267 |
| 4,259,028 | A | * | 3/1981 | Cook | 405/282 |
| 4,290,246 | A | * | 9/1981 | Hilsey | 52/169.1 |
| 4,453,861 | A | * | 6/1984 | Bretz et al. | 405/267 |
| 4,469,194 | A | * | 9/1984 | McBride | 182/107 |
| 4,664,560 | A | * | 5/1987 | Cortlever | 405/129.8 |
| 5,096,334 | A | * | 3/1992 | Plank | 405/283 |
| 5,259,705 | A | * | 11/1993 | Breaux et al. | 405/267 |
| 5,758,993 | A | * | 6/1998 | Schmednecht et al. | 405/267 |
| 6,240,700 | B1 | * | 6/2001 | Sheu | 52/741.13 |
| 6,402,963 | B2 | * | 6/2002 | Deniau | 210/170.07 |
| 7,481,604 | B2 | * | 1/2009 | Perpezat et al. | 405/267 |
| 7,785,042 | B2 | * | 8/2010 | Scandaliato | 405/285 |

FOREIGN PATENT DOCUMENTS

| | | | |
|---|---|---|---|
| EP | 1 070 793 | A1 | 1/2001 |
| EP | 1 630 301 | A1 | 3/2006 |
| NL | 7 903 935 | A | 11/1980 |

OTHER PUBLICATIONS

Search Report issued in FR 1054019 on Feb. 11, 2011.

* cited by examiner

*Primary Examiner* — Doug Hutton, Jr.
*Assistant Examiner* — Patrick Lambe
(74) *Attorney, Agent, or Firm* — Kenyon & Kenyon LLP

(57) ABSTRACT

A method for making a wall in soil. The method may include forming a trench in the soil; filling the trench with a self-hardening material; supplying at least one prefabricated element that has two plates connected together by a connection member; and positioning the prefabricated element in the trench filled with the self-hardening material.

12 Claims, 6 Drawing Sheets

WALL FORMED IN SOIL, THE WALL INCLUDING A HOLLOW PREFABRICATED ELEMENT, AND A METHOD OF MAKING SUCH A WALL

FIELD OF THE INVENTION

The present invention relates to the field of special works in the soil.

It relates more particularly to a wall formed in the soil, together with a method of making such a wall.

BACKGROUND OF THE INVENTION

Conventional diaphragm walls are known in which concrete is cast directly into a trench formed in the soil and after a cage of metal bars has been put into place.

Since the beginning of the 1970s, as an alternative solution to diaphragm walls, prefabricated walls have been used in which reinforced concrete elements, prefabricated either on site or in a workshop, are lowered into an excavated trench, which is then filled with a slurry of cement-bentonite for sealing the prefabricated elements to the ground in place.

The prefabricated wall technique is preferred in particular when the wall is incorporated in the final work and needs to satisfy aesthetic criteria, or when the thickness of the wall needs to be optimized, or when there are special sealing requirements.

Nevertheless, that technique presents drawbacks associated with the prefabricated elements that are used. Those elements require prefabrication workshops to be built or to exist close to the site. Furthermore, transporting the elements from the fabrication workshop to the site is lengthy and expensive because of their great weight.

OBJECT AND SUMMARY OF THE INVENTION

An object of the present invention is to provide a wall presenting all of the advantages of a conventional prefabricated wall, but also making it possible to lower costs and to limit the constraints associated with transport and with fabricating prefabricated elements.

Firstly, the invention provides a method of making a wall in soil, the method comprising at least the following succession of steps:

- forming a trench in the soil;
- filling said trench with a self-hardening material;
- supplying at least one prefabricated element comprising two plates connected together by connection means; and
- positioning said prefabricated element in said trench filled with said self-hardening material.

Generally, the prefabricated element used in the method of the invention is a retaining element, and the wall obtained by the method serves mainly for a retaining function. Surprisingly, the wall made using the method of the invention presents characteristics of strength, in particular bending strength, that are substantially identical to those of a conventional prefabricated wall in which use is made of prefabricated elements made of reinforced concrete.

Preferably, prior to being inserted in the trench (i.e. while it is being fabricated), the prefabricated element used in the method of the present invention is constituted of two plates that are placed facing each other, parallel to each other, and spaced apart from each other, being connected together by connection means. The prefabricated element is thus provided with at least one hollow between its two plates.

By way of example, the plates of the prefabricated element may be made of concrete.

The connection means of the prefabricated element should be understood as being any element or a plurality of elements suitable for connecting together and securing the two plates, while maintaining spacing and at least one hollow between the two plates. Preferably, the connection means are configured in such a manner as to conserve a longitudinal hollow between the two plates, the longitudinal hollow extending over the full height of the prefabricated element. By way of example, these connection means may be metal elements of the stiffener type or they may be section members.

The use of a hollow prefabricated element (i.e. an element presenting at least one hollow) make it possible to reduce the total weight that needs to be transported to the site, while conserving the finish qualities of conventional prefabricated walls.

The method may be implemented using any self-hardening material suitable for sealing the prefabricated element to the soil in place, for example a slurry of cement taking the place of the soil in place, or a mixture of the soil in place with a self-hardening slurry obtained using one of the techniques known under the term "soil mixing". No expensive material, such as concrete, is cast on site, thereby limiting fabrication costs.

Finally, this method serves to limit the amount of cuttings that need to be extracted, thus making the method better adapted to environmental constraints. The quantity of self-hardening material that is finally incorporated in the work is much greater than when using conventional prefabricated walls because of the material that fills the hollow between the two plates of the prefabricated element and that remains in place in the trench. Consequently, the quantity of material that needs to be removed after the prefabricated element(s) has/have been put into place in the trench is reduced.

Once the prefabricated element(s) is/are positioned in the trench, and once the self-hardening material has solidified, an adjacent zone of ground defined by one of the side faces of the wall is generally removed. The prefabricated element then serves to retain the earth.

According to an aspect of the invention, the self-hardening material is constituted by an added self-hardening slurry that takes the place of the soil excavated from the trench. Such a self-hardening slurry may be used directly as a drilling fluid. In a variant embodiment, the self-hardening slurry is put into place in two stages. The trench is initially excavated using a drilling mud (conventionally a bentonite mud). Once the trench has been excavated, the mud is replaced by the self-hardening slurry.

According to another aspect of the invention, the self-hardening material is constituted by a mixture of additional self-hardening slurry and a fraction of the soil in place. This technique, also known as "soil mixing", is advantageous, economically speaking. The soil in place is reused directly in the work, without needing any prior extraction or treatment. To do this, use is made of a known drilling and mixing tool. This technique makes it possible to reduce the volume of materials for transporting to the site, thus reducing costs associated with the materials and with their transport. Simultaneously, the volume of cuttings that needs to be removed is also decreased, thereby enabling the building process to be accelerated and further enabling costs and transport constraints to be reduced.

In another aspect of the invention, the prefabricated element is vibrated while it is being lowered into the trench, thereby making it easier to put into place. This provision is particularly advantageous when the self-hardening material presents density that is relatively high, since that hinders lowering the prefabricated element into the inside of the trench.

According to another aspect of the invention, two low guide walls marking the desired location for the wall are made in the soil that is to be excavated, and the trench is made vertically between those two low guide walls. After inserting into the trench the prefabricated element that includes positioning members at its top end, the element is held in position in the trench by using holding means that co-operate with these positioning members and that bear transversely on the low guide walls.

In another aspect of the invention, a first prefabricated element and then at least one second prefabricated element are put into a position in the trench. On its side facing towards the second prefabricated element, the first prefabricated element includes at least one hollow housing extending in the height direction of the first prefabricated element. The second prefabricated element includes at least one guide of profile complementary to said housing, which guide is fixed on its side facing towards the first prefabricated element. To connect the second prefabricated element to the first prefabricated element, the guide of the second prefabricated element is then threaded progressively into the housing of the first prefabricated element until the top faces of the two prefabricated elements are at substantially the same height.

While inserting the second prefabricated element, a sealing gasket previously fastened to the second prefabricated element and extending substantially up its entire height may be threaded in the housing of the first prefabricated element. In addition to its support function, the wall may also have a sealing function. The sealing gasket improves such sealing.

In another aspect of the invention, a protection part is inserted inside the housing of the first prefabricated element before it is inserted into the trench. This protection part is subsequently progressively cleared away while the guide of the second prefabricated element is being inserted into said housing.

In another aspect of the invention, the first trench is extended, at least one of its ends, by a second trench.

Prior to digging the second trench, a temporary protection element is advantageously placed in the first trench, facing the location that is to be occupied by the second trench. This protection element presents a width and a height that are at least substantially identical to the width and the height of the prefabricated element. If necessary, its dimensions may be greater so as to make it possible to prevent the self-hardening material that is situated in the first trench and that has not yet solidified from mixing with the mud or any other temporary filler material in the second trench, before the second trench is filled with self-hardening material and is ready to receive one or more prefabricated elements. It serves above all to preserve the prefabricated element of the first trench from any damage caused by the drilling machine used for excavating the second trench.

The temporary protection element may be removed from the first trench after the second trench has been excavated and before a prefabricated element is inserted into the second trench.

Secondly, the invention provides a wall formed in soil, the wall including at least one prefabricated element and self-hardening material coating said prefabricated element at least in part, wherein, while it is being fabricated, the prefabricated element is constituted by two plates placed facing each other, parallel to each other, and spaced apart from each other, being connected together by connection means, such that the prefabricated element is provided with at least one hollow.

According to the invention, before being inserted into the trench, the prefabricated element comprises two plates facing each other, parallel to each other, and spaced apart, while being connected together by connection means.

By way of example, the plates of the prefabricated element may be made of concrete.

The connection means of the prefabricated element should be understood as comprising any element or plurality of elements suitable for connecting and securing the two concrete plates together while maintaining a spacing and at least one hollow between the two plates. Preferably, the connection means are configured in such a manner as to conserve a longitudinal hollow between the two plates, the longitudinal hollow extending over the full height of the prefabricated element.

In an aspect of the invention, the connection means are made of metal.

Under such circumstances, they may comprise metal stiffeners associated, in particular by binding and/or by welding, with at least one metal bar (e.g. a wire mesh) embedded in each of the two plates.

In another example, these connection means may be metal section members. They may comprise metal bars of I section, in which the flanges are embedded in respective ones of the concrete plates, with the web connecting the plates together. Such metal bars may extend over substantially the full height of the prefabricated element. Optionally, the web of each of these metal bars may also be coated in concrete.

In an advantageous aspect of the invention, the percentage of the width of the wall that is occupied by the self-hardening material is not less than 50%, and is preferably not less than 75%, when viewed in the transverse direction of the wall across the hollow in the prefabricated element. In this way, the quantity of material that needs to be cleared away after putting the prefabricated element into place is limited. Furthermore, inserting the prefabricated element into the self-hardening material is made easier, in particular when the self-hardening material is relatively dense.

In another aspect of the invention, at least one of its ends, the prefabricated element includes at least one hollow housing that extends in its height direction, and at its opposite end, it includes a guide of shape that is complementary to said hollow housing.

When the connection means are made of metal, the hollow housing may be formed by a split metal tube, e.g. connected to the connection means by welding. The hollow housing may also be cast with one of the concrete plates of the prefabricated element.

Setbacks may also be formed in at least one of the plates of the prefabricated element.

BRIEF DESCRIPTION OF THE DRAWINGS

Other characteristics and advantages of the invention appear on reading the following description of embodiments of the invention given by way of non-limiting illustration. The description refers to the sheets of the accompanying drawings, in which.

MORE DETAILED DESCRIPTION

The prefabricated walls are made conventionally out of individual panels, either in succession or in alternation.

With reference to FIGS. 1 to 9, there follows a description of how a wall 10 of the invention is made using successive panels. All of the techniques described are naturally applicable to make a wall using alternating panels, or indeed making a wall that is constituted by a single individual panel.

Figure 1:
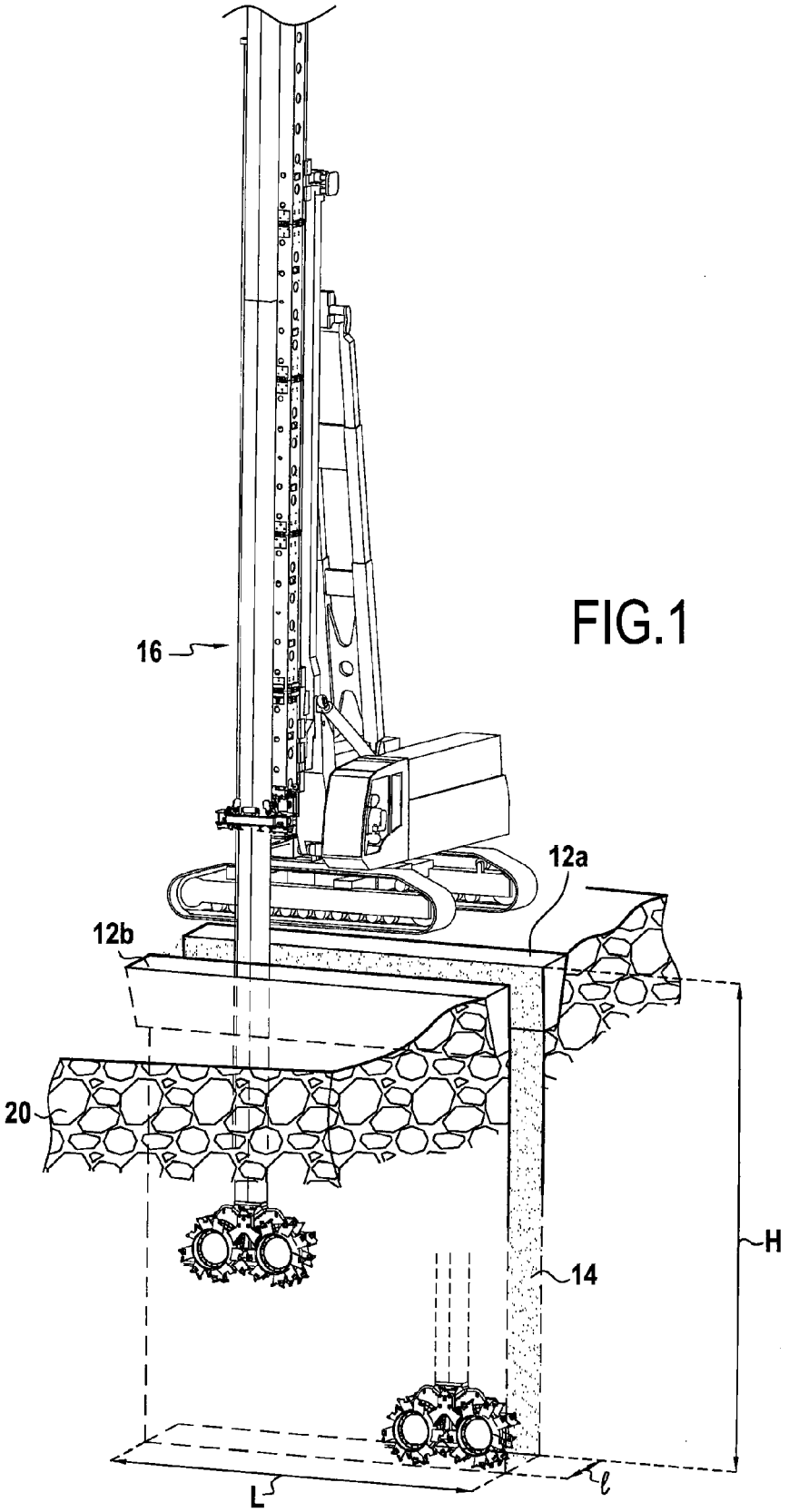
FIG. 1 shows the step of forming a first trench, to make a wall of the invention.

A first step of the method, shown in FIG. 1, consists in making low guide walls 12*a*, 12*b* serving to mark the location of the future wall 10. In the example, two mutually parallel low guide walls 12*a* and 12*b* define a space of constant width l corresponding substantially to the width desired for the future wall. These low guide walls 12*a*, 12*b* are generally made of reinforced concrete and they present a height lying in the range about 0.5 meters (m) to about 1.50 m. Their function is to ensure stability of surface ground, constituting leveling markers, and serving as bearing members for means for holding prefabricated elements that are required when making the wall and that are described in greater detail below with reference to FIG. 3. The low guide walls 12*a*, 12*b* are generally constituted by temporary work that are designed to be destroyed once the wall 10 has been terminated.

In a second step, a trench 14 of height H and of width l corresponding to those desired for the wall 10 is dug vertically between the two low guide walls 12*a*, 12*b* using a drilling and/or mixing machine 16.

Figure 2:
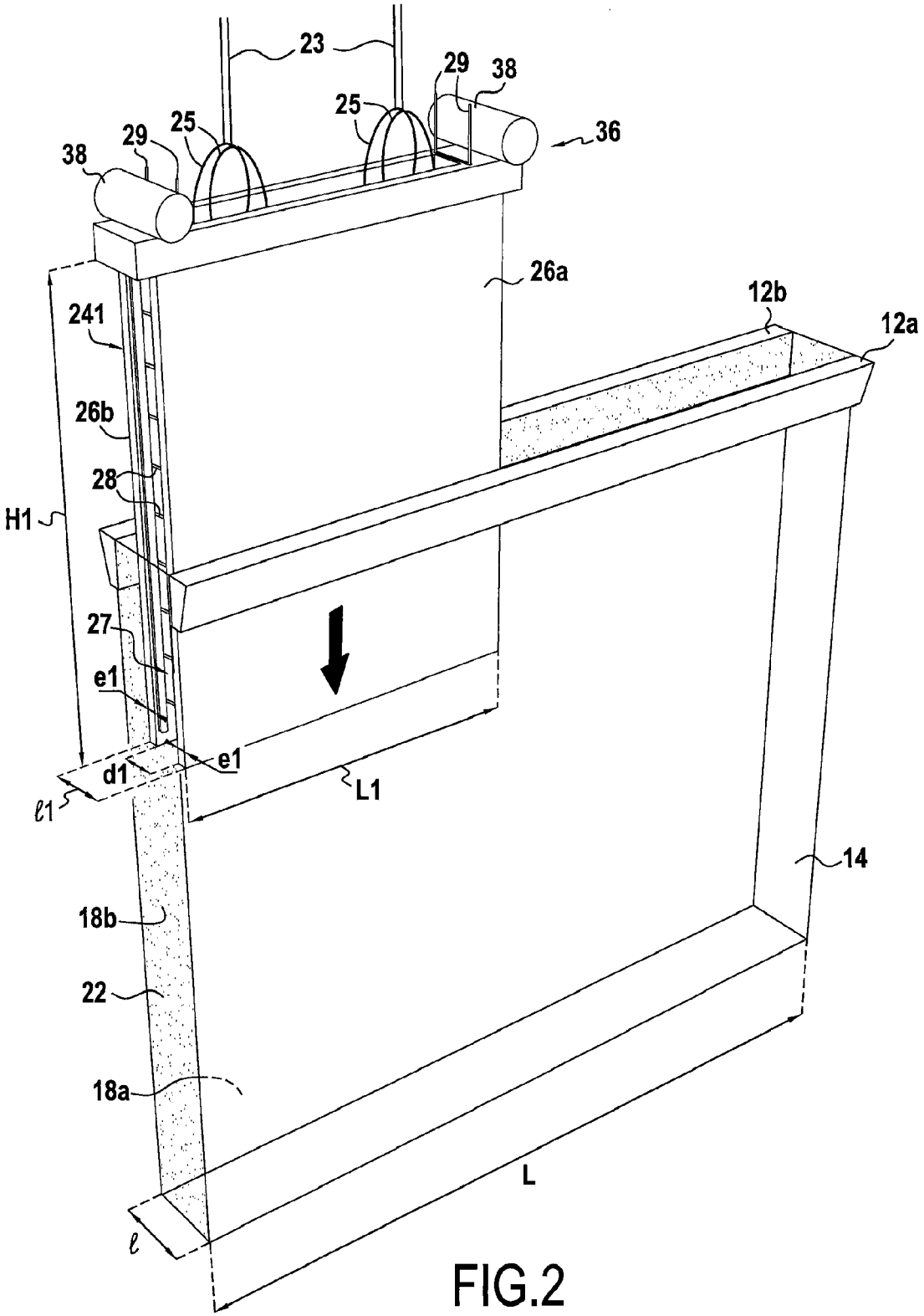
FIG. 2 shows the step of inserting a first prefabricated element in the first trench.

The trench 14 presents an elongate shape extending over a length L. As shown in FIG. 2, it has two longitudinal walls 18*a* and 18*b* that are spaced apart by a constant distance l, each of them extending vertically in line with one of the two low guide walls 12*a*, 12*b*. The trench 14 marks the future location of the wall 10 and it defines a zone 20 that is to be cleared.

In order to ensure that the trench 14 is stable during the drilling operation, and in particular in order to avoid the walls 18*a* and 18*b* caving in, the trench 14 is filled, while it is being drilled, with a mud, generally a mud based on bentonite.

In a third step, the trench 14 is subsequently filled with a self-hardening material 22 for covering one or more prefabricated elements, as described with reference to FIG. 2, and, once solidified, for sealing these prefabricated elements to the ground in place.

Advantageously, the self-hardening material 22 is made by mixing a self-hardening slurry, e.g. a cement slurry, with the ground in place. The use of this so-called "soil-mixing" technique serves to reduce the amount of material that needs to be removed by at least half, and also makes it possible to use a smaller quantity of self-hardening slurry.

In another example, drilling may be performed using a bentonite mud as described above, but the self-hardening material 22 is constituted by a cement-based slurry (e.g. a cement-bentonite slurry) with which the trench is filled at the end of drilling. In yet another variant implementation, the drilling may be performed directly using a cement-based slurry (e.g. a cement-bentonite slurry), which constitutes the self-hardening material.

In a fourth step, and as shown in FIG. 2, a first prefabricated element 241 is inserted progressively into the trench 14. To do this, a hoist having slings 23 is attached to hoist cables 25 secured to the prefabricated element. In parallel, its side face facing towards the zone that is to be removed 20 is preferably washed in a form-release material (i.e. progressively while it is lowered into the trench 14). This operation may also be performed prior to lowering the prefabricated element into the trench.

In the example shown in FIG. 2, the prefabricated element 241 comprises two concrete plates (or skins) 26*a* and 26*b* that are connected and held together by metal bars 28. The plates 26*a*, 26*b* present the same length L1, the same thickness e1 and the same height H1. They are placed facing each other, parallel to each other, and spaced apart by a distance d1. The prefabricated element 241, of width l1 is thus provided with a hollow 27 between its two plates 26*a*, 26*b*. It should be observed that in this example, the metal bars situated in the hollow 27 are not coated in concrete.

While the prefabricated element 241 is being inserted into the trench 14, the hollow 27 is filled with the self-hardening material 22 that coats the metal bars 28. In other embodiments, it should be observed that the two plates 26*a*, 26*b* of the prefabricated element may present dimensions (width, length, thickness) that are different from each other.

Positioning members 29 project from the top end of each plate 26*a*, 26*b*. These positioning members are constituted, for example, by threaded rods 29 that perform a function that is described in greater detail with reference to FIG. 3.

Other top-face elements (e.g. starter bars) or indeed setbacks for receiving installations such as anchoring draw bars may also be provided on one or both of the plates 26*a*, 26*b*.

Figure 3:
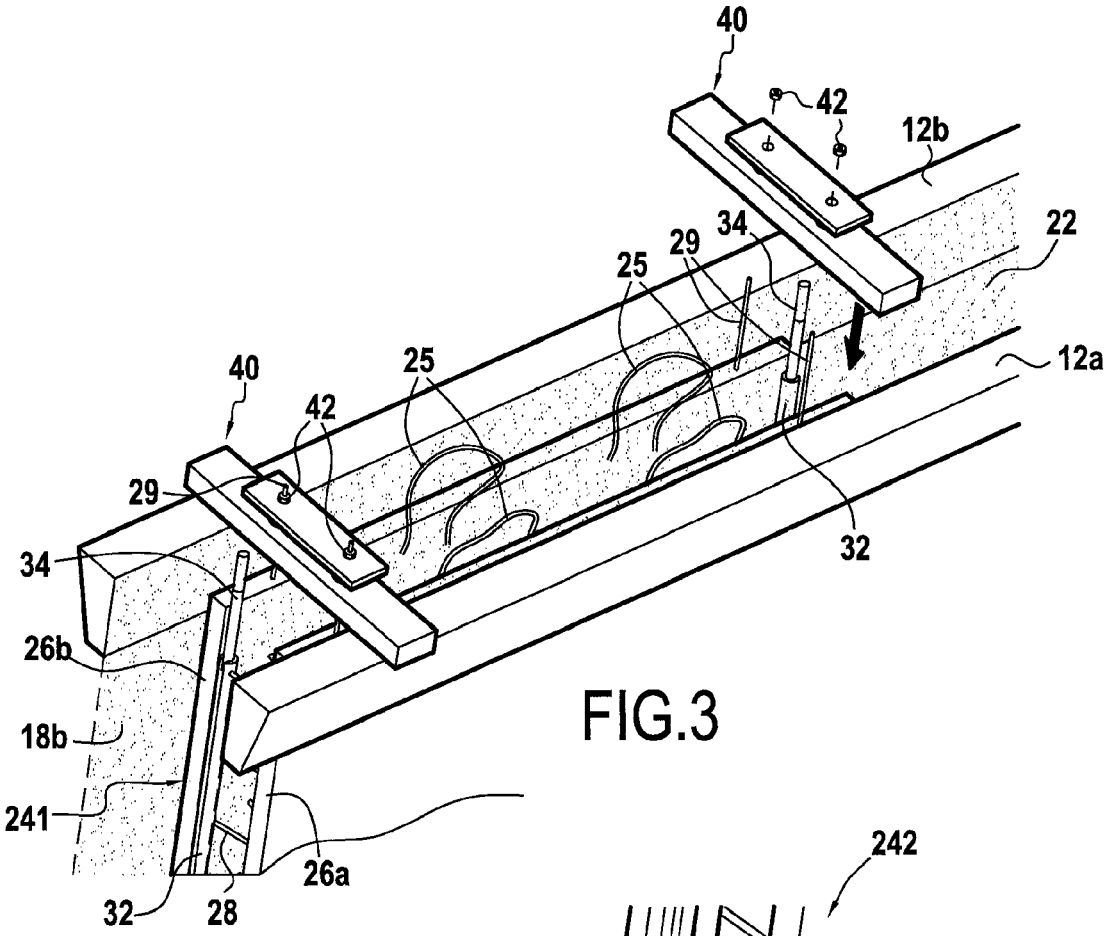
FIG. 3 shows a step of holding the first prefabricated element in position inside the first trench.

In the example shown in FIG. 3, the prefabricated element 241 includes, at each of its lateral ends, between its two plates 26*a* and 26*b*, and in contact with one of said plates, a split metal tube 32 defining a hollow housing 30. The split tube 32 extends over substantially the entire height H1 of the plates 26*a*. Its function is described in greater detail with reference to FIGS. 4 and 5.

By way of example, the split tube 32 is cast together with one of the two plates 26*a* and 26*b*. In other embodiments, it may be connected by welding to the metal bars 28 or to other metal elements connecting together the two plates 26*a*, 26*b* of the prefabricated element 241. In yet another embodiment, at least two split tubes 32 or some other type of hollow housing may be provided on one or both sides of the prefabricated element.

As shown in FIG. 3, a protection part 34, e.g. a rod of appropriate dimensions, is inserted in each tube 32 before the prefabricated element 241 is lowered into the trench 14. The protection part 34, e.g. made of a crumbling or deformable material, is to prevent any material intruding into the split tube 32 before the prefabricated element 241 is connected to an adjacent prefabricated element (this step is described in greater detail with reference to FIGS. 4 and 5). The protection part 34 thus fills the split tube 32 over its entire length.

In some configurations, the high density of the self-hardening material 22 makes it difficult to cause the prefabricated element 241 to penetrate into the trench 14 merely under the effect of its own weight. As in the example described, this occurs generally when the self-hardening material 22 is a soil-cement mixture. In order to facilitate penetration of the prefabricated element 241, it may be caused to vibrate, e.g. by means of a frame 36 carrying electrical vibrators 38 positioned at its top end during the stages of hoisting it and positioning it in the trench 14. By virtue of such vibration, the prefabricated element 241 is then easily brought into its final position in the trench 14.

In a fifth step, the prefabricated positioning element 241 inside the trench 14 is adjusted and held by holder means such as those described below with reference to FIG. 3.

As mentioned above, each plate 26*a*, 26*b* of the prefabricated element 241 has positioning members in the form of a plurality of threaded rods 29 projecting from its top face. These rods 29 extend in the height direction of the prefabricated element 241 and they are of a length that is sufficient to pass right through a spacer 40 that bears transversely on the low guide walls 12*a*, 12*b*. The prefabricated element 241 is thus held in position by nuts 42 co-operating with the threads on the rods 29 and bearing on the top face of the spacer 40.

In a variant embodiment, the positioning members may be positioning loops provided at the top end of the prefabricated element 241, and the holder means may be bars that are passed through said loops and that bear transversely on the low guide walls 12*a*, 12*b*.

Figure 4:
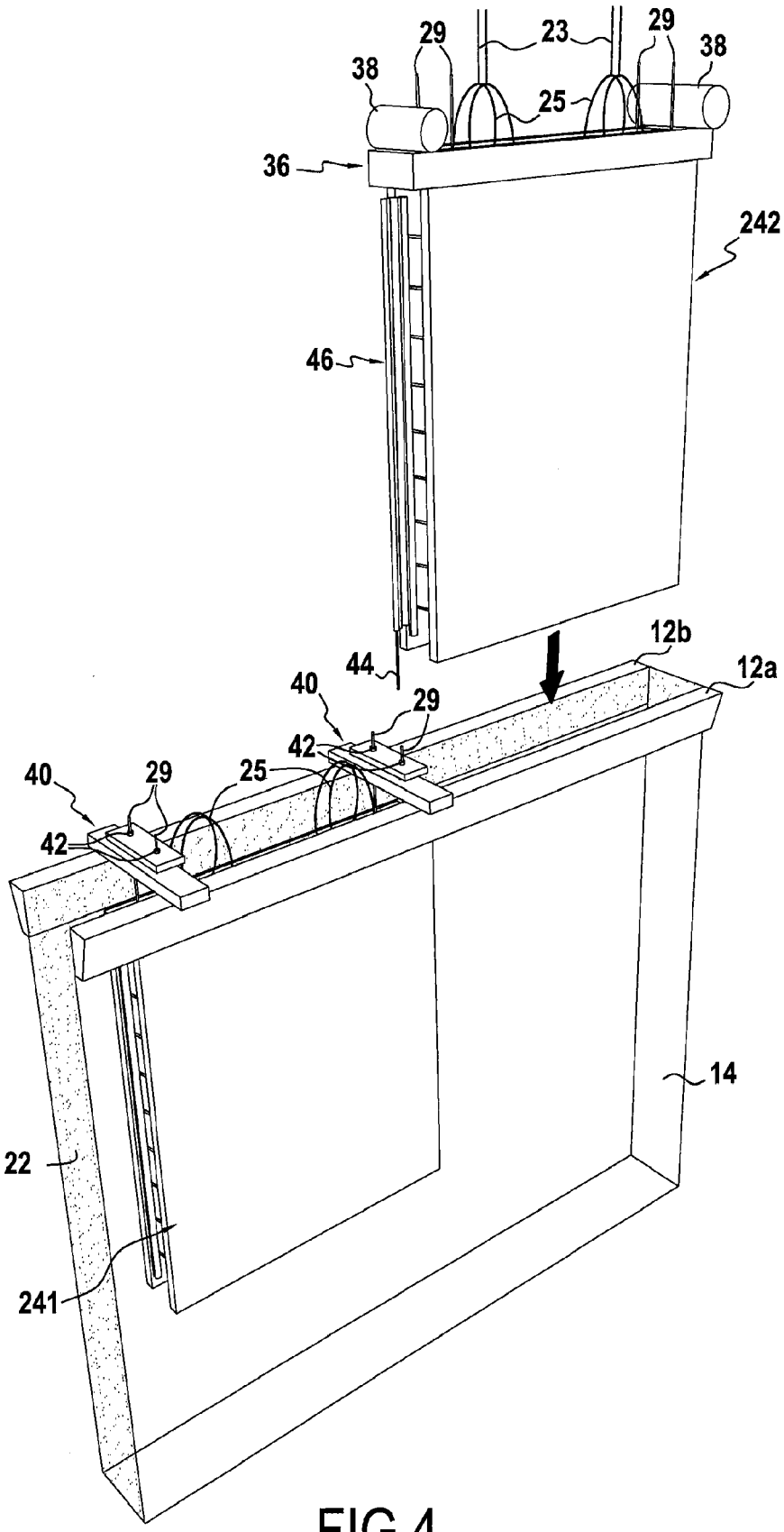
FIG. 4 shows the step of inserting a second prefabricated element in the first trench.

In the example described, the trench 14 presents a length L that is substantially greater than twice the length of the prefabricated element 241. In a sixth step and, as shown in FIG. 4, a second prefabricated element 242 is positioned in the trench 14, beside the first prefabricated element 241.

The operations of hoisting and inserting the second prefabricated element 242 are completely identical to those described above with reference to FIGS. 1 to 3. They are therefore not described again.

Figure 5:
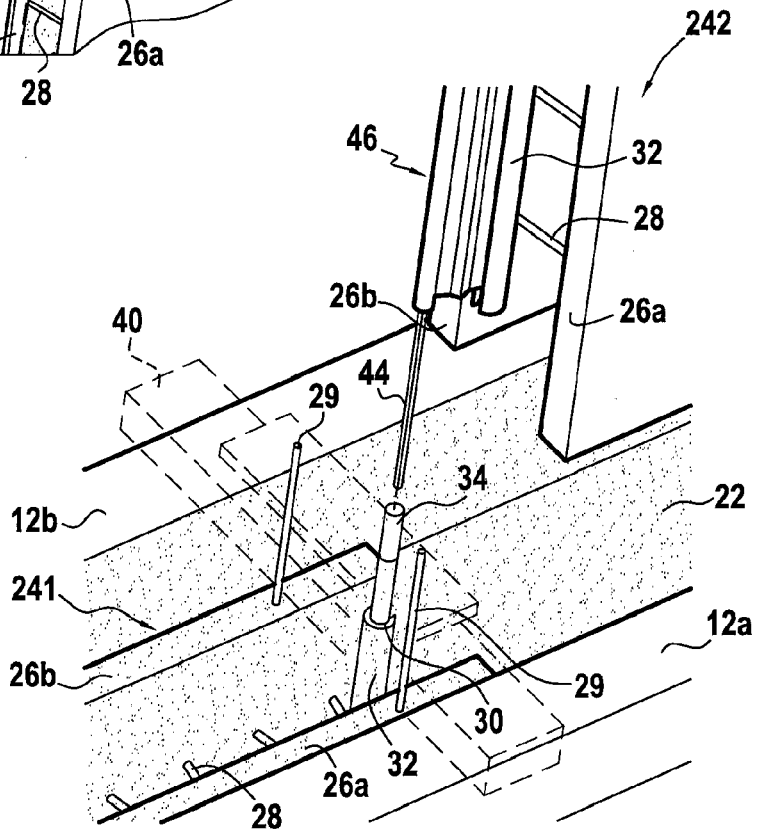
FIG. 5 is a detail view of the blade of the second prefabricated element, and also of the housing of the first prefabricated element with which it is to co-operate.

As can be seen more particularly from FIG. 5, the second prefabricated element 242 includes, on its side facing towards the first prefabricated element 241 and, at its bottom end, a metal blade 44 of profile complementary to the housing 30 formed by the split tube 32 of the first prefabricated element 241.

On its side facing towards the first prefabricated element 241, the second prefabricated element 242 is also provided with a split tube 32 similar to that of the first prefabricated element 241. As shown in FIG. 4, a sealing gasket 46, and in particular an inflatable water-stop type gasket, is connected to the split tube 32.

Figure 6:
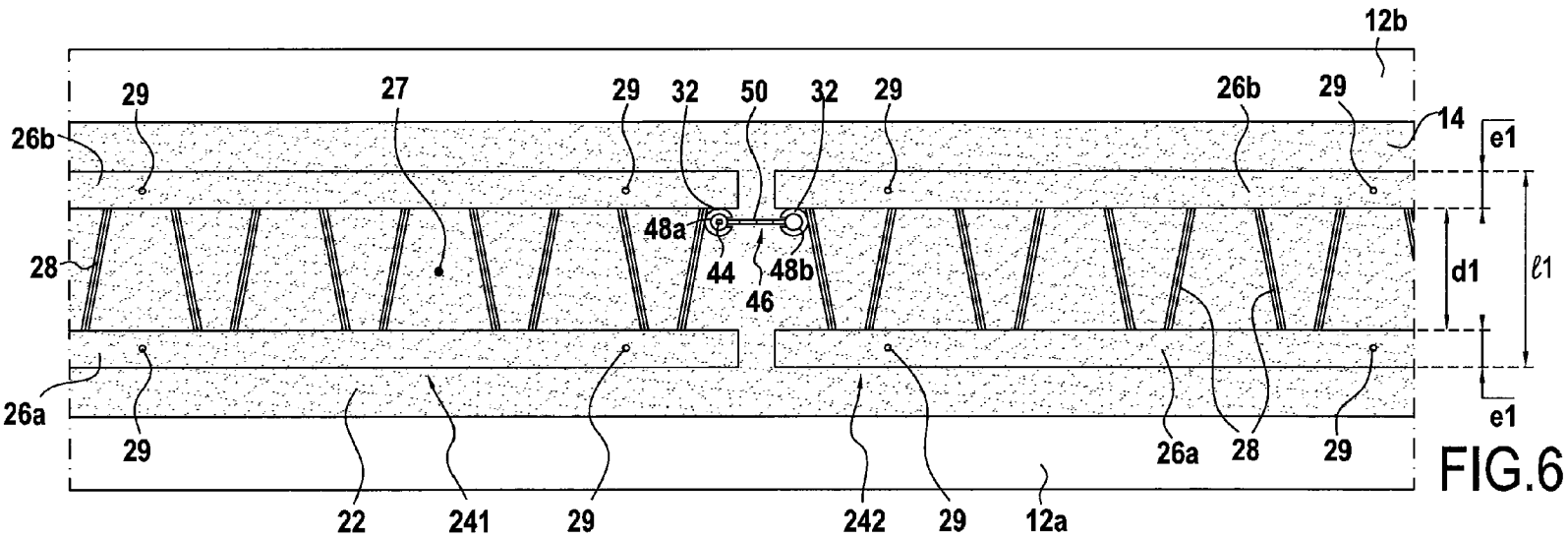
FIG. 6 is a fragmentary elevation view of the first trench after insertion of the first and second prefabricated elements, showing in particular one example of a gasket that may be used in the present invention.
Figure 7:
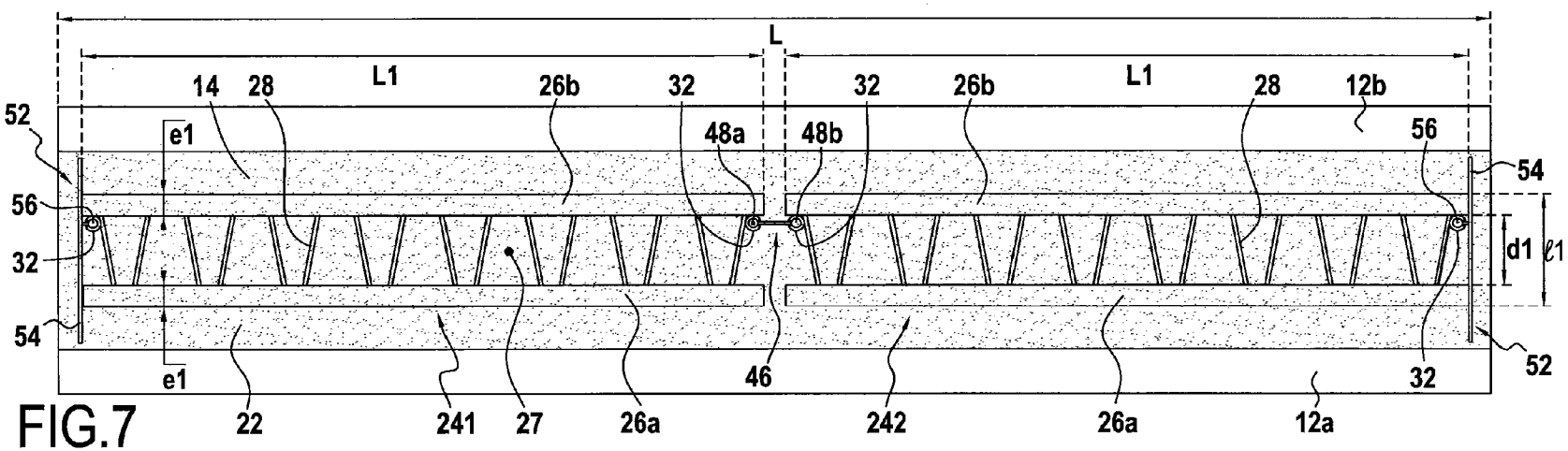
FIG. 7 shows a following step of the method, being an elevation view of the first trench in which protection elements have been positioned.

As can be seen in FIG. 6, a water-stop gasket 46 comprises two inflatable hollow tubes 48*a*, 48*b* and an intermediate part 50 connecting the two tubes 48*a* and 48*b* together.

Prior to positioning the second prefabricated element 242 in the trench 14, a first inflatable tube 48*b* is inserted in its split tube 32 that is to face towards the first element 241.

On being lowered into the trench 14, the blade 44 has the function of guiding and positioning the second prefabricated element 242 relative to the first prefabricated element 241. For this purpose, when the second prefabricated element 242 is lowered in the empty space adjacent to the first prefabricated element 241 by means of the hoist, its blade 44 is engaged in the adjacent split tube 32 of the first prefabricated element 241 until the top faces of the two prefabricated elements 241 and 242 are at substantially the same height. By sliding along the housing 30 formed by the split tube 32, the blade 44 progressively removes the protection part 34, e.g. by breaking it or by deforming it, or by pushing it out into the bottom of the trench 14.

The blade 44 of the second prefabricated element also participates in guiding the second inflatable tube 48*a* inside the split tube 32 of the first prefabricated element 241.

Sealing is provided by injecting a cement slurry into each of the inflatable tubes 48*a*, 48*b* so as to cause each of them to inflate sufficiently to obtain close contact between the inflatable tube and the inside wall of the split tube 32 in which it is positioned.

In a seventh step, protection elements 52 are positioned in the trench 14, facing each location provided for an adjacent trench.

In the example described, each protection element 52 is in the form of a metal section member comprising a main plate 54 of width and height that are substantially equal to those of the first trench, and a connection guide 56 connected to said plate 54 and presenting an arrangement and size that are adapted to enable it to be inserted in sliding into a split tube 32 of a prefabricated element 241, 242.

The connection guide 56 serves to position and hold each section member 52 relative to a prefabricated element 241, 242. It also has the function of preventing the self-hardening material filling the split tube 32 and beginning to set therein, in particular in the event of a prolonged stoppage on site.

The main plate 54 serves to preserve the prefabricated element 242 of the first trench 14 from any damage caused by the drilling and/or mixing machine 16 used for excavating the adjacent trench. It may also serve to prevent the self-hardening material 22 that is situated in the first trench 14 and that has not yet solidified from mixing with the mud or any other temporary filler material in the adjacent trench, before it is filled with self-hardening material and is ready to receive one or more prefabricated elements.

Figure 8:
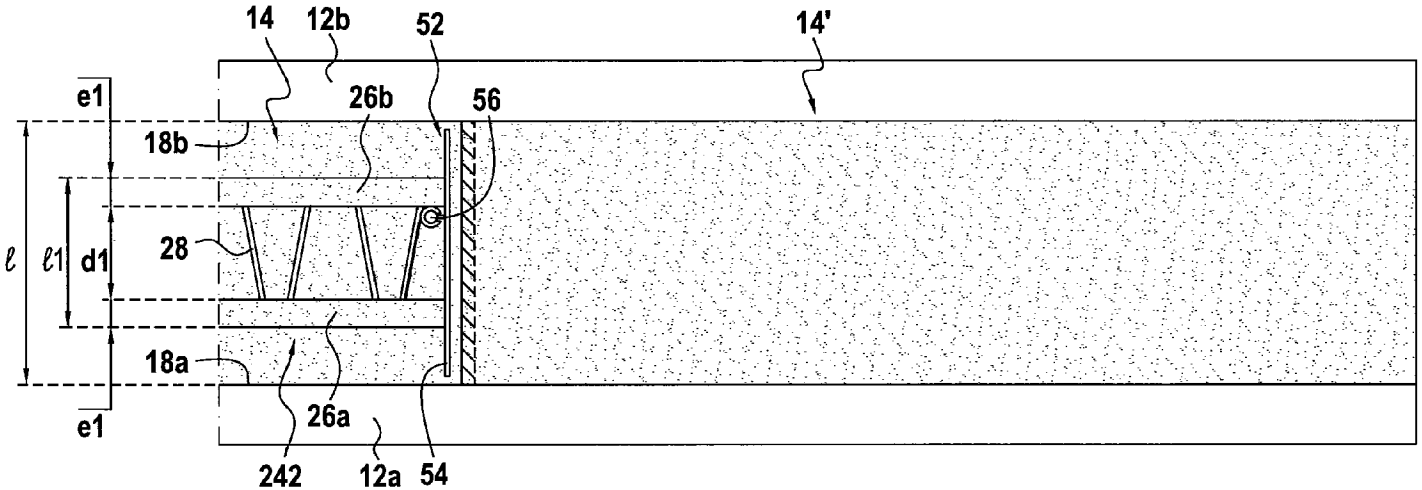
FIG. 8 shows the step of excavating a second trench adjacent to the first.
Figure 9:
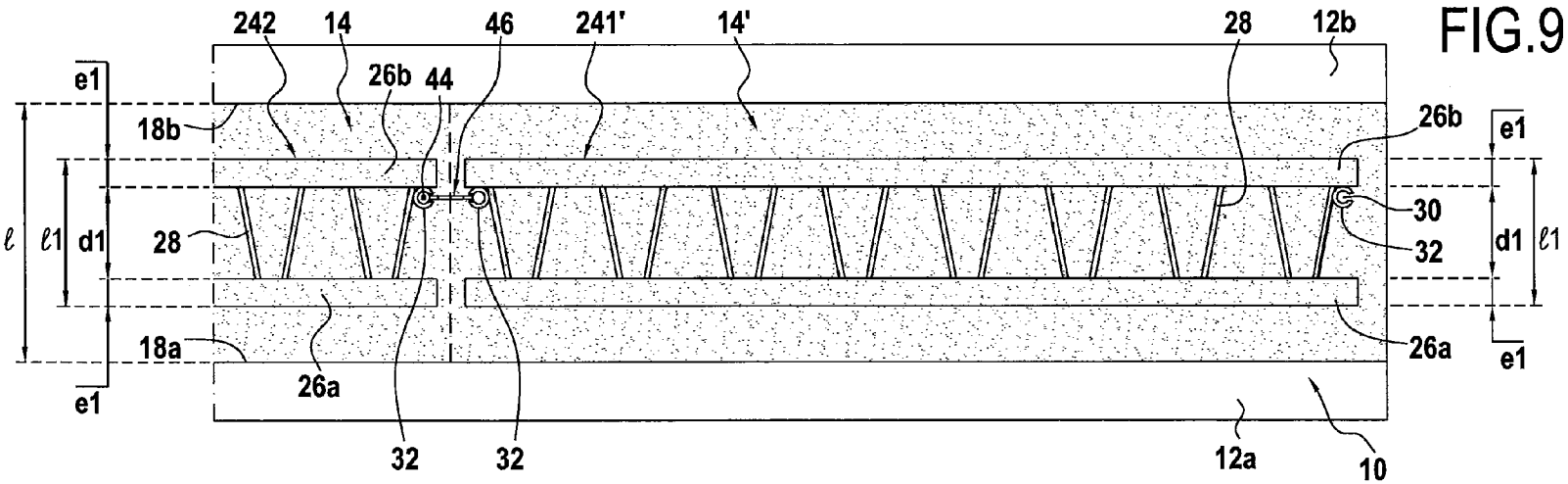
FIG. 9 is a fragmentary elevation view of the first and second trenches once the wall has been finalized.

Once the section member 52 has been put into position, and as shown in FIG. 8, a second trench 14' (in this example, having the same width and height as the first trench) is drilled out to the right of the first trench 14. The section member 52 may then serve as a guide for the secondary drilling by means of the drilling and mixing machine 16. In another embodiment, the section member 52 is positioned at a distance from the end of the first trench 14 that is sufficient for it to be dug out again when excavating the second trench 14'.

After drilling the second trench 14', the adjacent section member 52 is removed and then a prefabricated element 241' is inserted in the second trench 14', using the same steps as those described with reference to FIGS. 2 to 5.

In order to facilitate positioning thereof, this prefabricated element 241' includes, on its side facing towards the first trench 14, a blade 44 that is to be engaged progressively in the split tube 32 of the adjacent prefabricated element 242 in the first trench 14 (and facing towards the second trench 14') until the top faces of the two prefabricated elements 242 and 241 are at substantially the same height.

Once more, during insertion of the prefabricated element 241 into the second trench 14', a sealing gasket 46 previously connected to said prefabricated element 241' of the second trench 14' and extending substantially along its full height, may be threaded in the split tube 32 of the second prefabricated element 242 of the first trench 14.

All of the above-described steps are then repeated until a wall 10 is obtained that has the desired length and profile.

Once the wall 10 has been terminated, the zone 20 is cleared to uncover one of the faces of said wall. The hardened remains of slurry that adhere to the uncovered faces of the prefabricated elements are finally removed by scraping, brushing, etc.

In an example embodiment of the invention, the width l of the wall 10 obtained by the above-described method is 600 millimeters (mm), the width l1 of the prefabricated element 241 is 400 mm, and the thickness e1 of each concrete plate 26*a*, 26*b* of the prefabricated element is 70 mm. By observing in the transverse direction of the wall 10, across the hollow 27 in the prefabricated element, the percentage of the width of the wall that is occupied by the self-hardening material 22 is (600−2×70)/600, i.e. about 75%. Advantageously, the dimensions for the wall, the prefabricated element, and the plates constituting the prefabricated element are selected so that this percentage is greater than 50%, and preferably greater than 75%. Such provisions serve to limit the quantity of expensive material (concrete) that is used, and thus to reduce costs. They also serve to facilitate inserting the prefabricated element in a self-hardening material that is relatively dense and compact, in particular when the self-hardening material is obtained by a soil-mixing method.

What is claimed is:

1. A method of making a wall in soil, the method comprising at least the following succession of steps:

forming a trench in the soil and filling the trench with a self-hardening material;

supplying at least one hollow prefabricated element comprising two plates spaced apart from each other and connected together by connection means, such that the prefabricated element includes an open lower end, and a hollow space is formed between the two plates;

positioning said hollow prefabricated element in said trench filled with said self-hardening material such that the open lower end faces the trench, and such that the hollow space formed between the two plates is filled with the self-hardening material to coat the connection means through the open lower end, whereby the solidification of the self-hardening material seals the hollow prefabricated element to the ground in place, and wherein the filling step occurs before the positioning step.

2. A method according to claim 1, wherein, after positioning the hollow prefabricated element in the trench, and after the self-hardening material has solidified, a zone of ground defined by one of the main faces of the wall is removed, whereby the hollow prefabricated element serves to support the soil.

3. A method according to claim 1, wherein the self-hardening material is constituted by an added self-hardening slurry that takes the place of the soil excavated from the trench.

4. A method according to claim 1, wherein the self-hardening material is constituted by a mixture of added self-hardening slurry and a fraction of the soil excavated from said trench.

5. A method according to claim 1, wherein the hollow prefabricated element is vibrated while being lowered into said trench, thereby making it easier to put the prefabricated element into place.

6. A method according to claim 1, wherein two low guide walls marking the desired location for the wall are made in the soil that is to be excavated, wherein the trench is formed vertically between the two low guide walls, wherein the hollow prefabricated element includes positioning members at a top end, and wherein after inserting the hollow prefabricated element in the trench, the prefabricated element is held in position in the trench by holder means that co-operate with said positioning members and that bear transversely against the low guide walls.

7. A method according to claim 1, wherein a first hollow prefabricated element and then at least one second hollow prefabricated element are put into position in said trench, the first hollow prefabricated element including, on a side facing towards the second hollow prefabricated element, at least one hollow housing extending in the height direction of said first prefabricated element, wherein the second hollow prefabricated element includes at least one guide of profile complementary to said housing, the guide being fastened to a side facing towards said first hollow prefabricated element, and wherein, in order to connect the second hollow prefabricated element to the first hollow prefabricated element, the guide of the second hollow prefabricated element is threaded progressively into the housing of the first hollow prefabricated element until the top faces of the two hollow prefabricated elements are at substantially the same height.

8. A method according to claim 7, wherein while inserting the second hollow prefabricated element, a sealing gasket previously fastened to said second hollow prefabricated element and extending substantially along the entire height thereof, is threaded in the housing of said first hollow prefabricated element.

9. A method according to claim 1, wherein a second trench is made adjacent to the first trench.

10. A method according to claim 9, wherein prior to excavating the second trench, a temporary protection element is placed in the first trench facing the location intended for the second trench, the protection element presenting a width and a height that are at least substantially identical to the width and the height of the hollow prefabricated element.

11. A wall made in accordance with the method according to claim 1.

12. A method of making a wall in soil, the method comprising at least the following succession of steps:

forming a trench in the soil and filling the trench with a self-hardening material;

filling said trench with a self hardening material;

supplying at least one prefabricated element comprising two plates connected together by connection means such that the prefabricated element includes an open lower end, and a hollow space is formed between the two plates; and positioning said prefabricated element in said trench filled with said self-hardening material such that the open lower end faces the trench, and such that the hollow space between the two plates is filled with the self-hardening material to coat the connection means through the open lower end, whereby the solidification of the self-hardening material seals the hollow prefabricated element to the ground in place, and wherein the self-hardening material is constituted by a mixture of added self-hardening slurry and a fraction of the soil excavated from said trench, and wherein the filling step occurs before the positioning step.

* * * * *